US006431823B1

(12) United States Patent
Slepoy

(10) Patent No.: US 6,431,823 B1
(45) Date of Patent: Aug. 13, 2002

(54) CENTRIFUGAL PUMP WITH VARIABLE CAPACITY AND PRESSURE

(76) Inventor: Yudko Slepoy, 32 Shlomo Hamelech Street, Beer Sheva (IL), 84547

( * ) Notice: Subject to any disclaimer, the term of this patent is extended or adjusted under 35 U.S.C. 154(b) by 0 days.

(21) Appl. No.: 09/615,823

(22) Filed: Jul. 13, 2000

(51) Int. Cl.[7] ..... F04D 27/00

(52) U.S. Cl. ..... 415/14; 415/126; 415/131; 415/150

(58) Field of Search ..... 415/126, 128, 415/148, 150, 14, 157, 158, 131, 132

(56) References Cited

U.S. PATENT DOCUMENTS 2,996,996 A * 8/1961 Jassniker ..... 415/126
3,032,259 A * 5/1962 Jassniker ..... 415/128
3,784,318 A * 1/1974 Davis ..... 415/158
4,527,949 A * 7/1985 Kirtland ..... 415/150
4,643,639 A * 2/1987 Caine ..... 415/148
4,802,817 A * 2/1989 Tyler ..... 415/157

* cited by examiner

*Primary Examiner*—Edward K. Look
*Assistant Examiner*—Richard Edgar

(57) ABSTRACT

A centrifugal pump includes a casing having an outlet chamber and an impeller rotatable in the casing. A set of controlling sideplates are installed in the outlet chamber. The controlling sideplates are movable along the axis of the impeller, positioned such as to change the outlet width and the chamber volume thus allowing one to obtain the desired pumping parameters. A driving mechanism is connected to the sideplates, for their axial movement. The design contains driving mechanisms of the hydraulic type and electrical type. A pair of pilot shafts are connected to the sideplates and extend into a sensor for controlling the movement of the sideplates. A control system is also provided whose main purpose is adjusting the axial displacement of the sideplates, which automatically controls the variable pumping parameters.

5 Claims, 3 Drawing Sheets

CENTRIFUGAL PUMP WITH VARIABLE CAPACITY AND PRESSURE

BACKGROUND OF THE INVENTION

The present invention relates to a pump with variable parameters.

Pumps with variable parameters for water and two-phase flow are necessary particularly because in the industry the liquid supply from technological processes to the pump facility is variable and is periodically limited. In industrial pumping systems there is always a danger that the pumps will lose prime, or cavitate and wear intensively. Therefore, it is necessary to use external means to throttle the pump discharge, or to deliver additional waste water to the pump suction to prevent the stoppage and intensive wearing of the pump.

Pump throttling is by far the most frequently used means to vary the pump capacity. However, as is known, throttling the pump discharge results in great waste of power. Pump capacity variation can be obtained by changing the rotation speed of the drive. This however can be realized by using engine or turbine drive, or electric motors with special electric system facilities for various speeds, which is complex and expensive.

Therefore, one of the major unsolved problems in centrifugal pumps is designing a pump which is able to self-regulate the working parameters automatically without using external means.

It is known that for regulating the capacity of centrifugal pumps one uses adjustable diffusion vanes arranged in the impeller or in the casing. This arrangement shows an appreciable gain in efficiency at reduced capacity. However, because of mechanical complications this method has not become practical.

The present invention involves a principle comprising a change in the geometry of the impeller and casing for varying the pump's capacity and pressure.

A patent and literature search reveals the existence of American designs which involve a method of changing the impeller geometry for varying pump capacity. A variable centrifugal pump design is presented in a General Electric Company U.S. Pat. No. 3,784,318 in which the pump capacity is varied by covering a part of the impeller outlet width by a cylindrical throttle positioned between said impeller and the casing diffuser vanes. In U.S. Pat. No. 4,527,949, the pump capacity of a centrifugal machine is varied by adjusting the diffuser passage between a fixed wall and an opposed, movable wall.

However, the mechanical complications make these direct methods impractical, especially for pumping suspensions with abrasive and other solid components. Another disadvantage is that great casing hydraulic losses are incurred when impeller discharge is reduced while the casing diffuser chamber volume and inlet size remain unchanged. It is known that casing hydraulic losses are the most considerable factor in the pump efficiency balance.

Other patented designs similar to the present one under consideration, are those of turbocompressor radial diffusers presented in U.S. Pat. Nos. 2,996,996 and 3,032,259.

Thus, in U.S. Pat. No. 2,996,996 a radial diffuser is presented for a radial turbomachine having a movable wall and an apparatus having a plurality of guide vanes enabling it to regulate this apparatus inside the diffuser for reducing losses. In U.S. Pat. No. 3,032,259 a turbocompressor is presented having a radial diffuser which has a passage adjacent the casing outlet chamber. One wall of this passage is movable after a rotary motion of a ring element.

As to gas turbocompressors, diffuser guide vane apparatus with adjustable vanes are used to reduce losses at the change of the compressor discharge. In hydraulic pumps, by contrast to turbocompressores, radial diffusers with guide vanes are used only in exclusive cases. Such a case has been analyzed above.

Since pumps function by liquid, which is a non-compressible medium, its movement in the diffuser is connected with vortex formations at the change of the pump discharge. As a consequence, hydraulic losses in the pump diffuser (outlet chamber) are significantly greater than in the compressor diffuser where gas is a compressible medium. As a result, the greatest losses in balance power of the pump lies with the outlet chamber (diffuser). Therefore, there is a problem of reducing hydraulic losses in the pump outlet chamber when its discharge is variable.

SUMMARY OF THE INVENTION

The object of the present invention is to provide an efficient centrifugal pump having variable capacity and pressure the overcomes the drawbacks and disadvantages of that prior art. The invention solves in a novel manner the problem of changing the pumping parameters allowing one to obtain the desired capacity and pressure under changing conditions so as to maintain its pumping efficiency and minimize energy losses. This is achieved by providing a set of movable controlling sideplates as supplementary walls inside the outlet chamber, movable axially along the impeller. Their position changes the outlet width of the impeller and simultaneously the chamber volume, allowing one to obtain the desired pumping parameters. This new design is advantageous since the impeller outlet width is partly changed and the pump discharge is reduced, the volume of the casing is also reduced correspondingly. This prevents the creation of vortex flow in the casing chamber under changing parameters. In addition, the controlling sideplates are designed such that the movement of the flow in the casing outlet chamber is in the form of a double inward spiral which is optimal for the prevention of vortex flow and in particular for reducing wear when pumping abrasive suspensions. Both the control of the chamber volume by the sideplates and the shape of the sideplates causing the spiral motion, prevent vortex formation and improves the efficiency of the pump while varying its parameters.

In the design a driving mechanism is connected to the controlling sideplates for their axial movement. The invention contains driving mechanisms that are of the hydraulic type or electrical type according to the convenience of the user. The hydrodriving mechanism is achieved in two different designs: one external to the casing and the other arranged internally being incorporated into the controlling sideplates. The internal hydrodriving mechanism has also one of its embodiments wherein the controlling sideplates are elastic (such as rubber) and is part of the casing inner liner. The inner lining of the sideplates protects the casing from wear, particularly when handling abrasive suspensions.

The pump's parameters are varied automatically. To achieve this, a driving mechanism is included in a control system whose main purpose is to move the controlling sideplates automatically and thus control the variable pumping parameters.

DETAILED DESCRIPTION OF THE INVENTION

Figure 1:
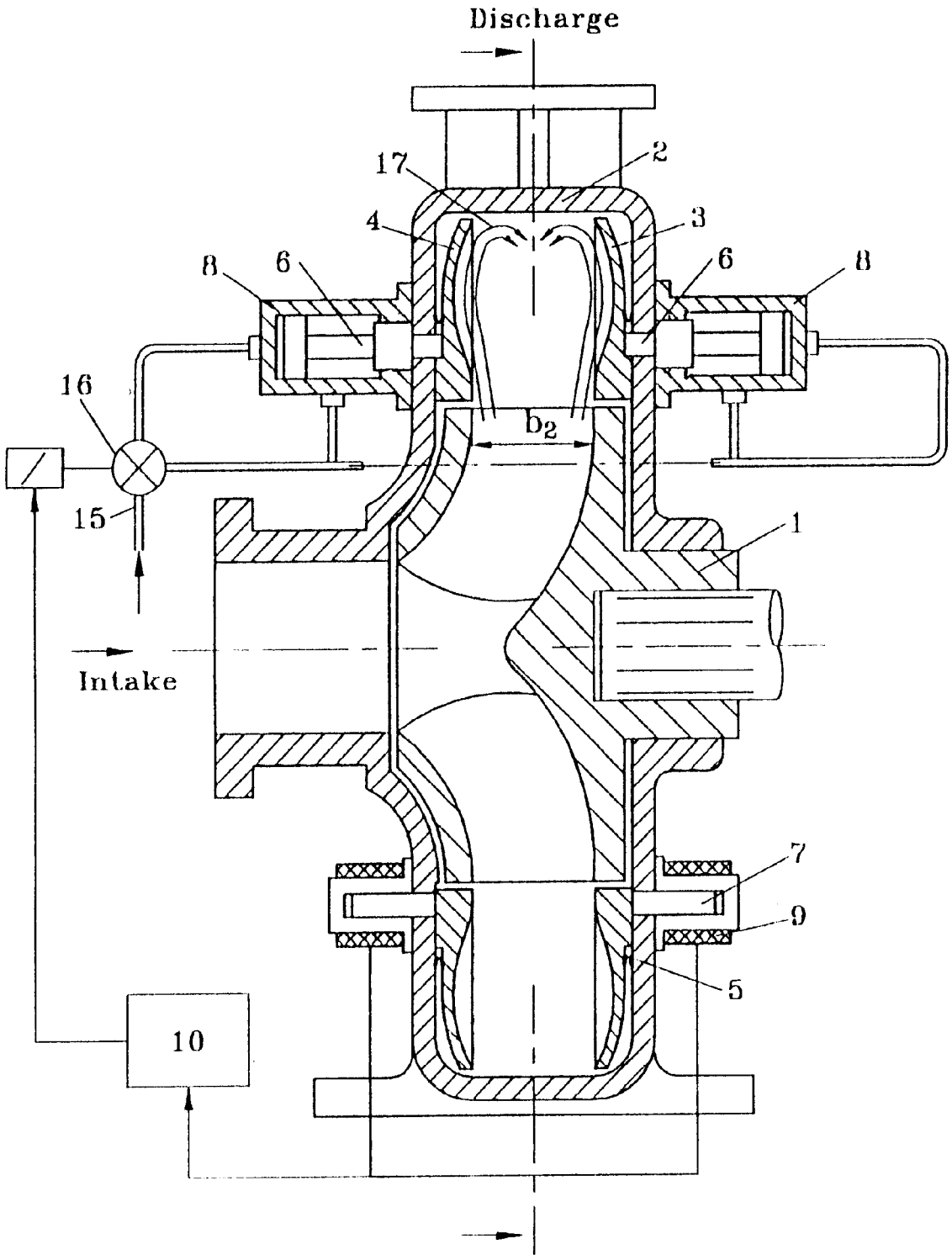
FIG. 1 is a cross-sectional view of the centrifugal pump.
Figure 2:
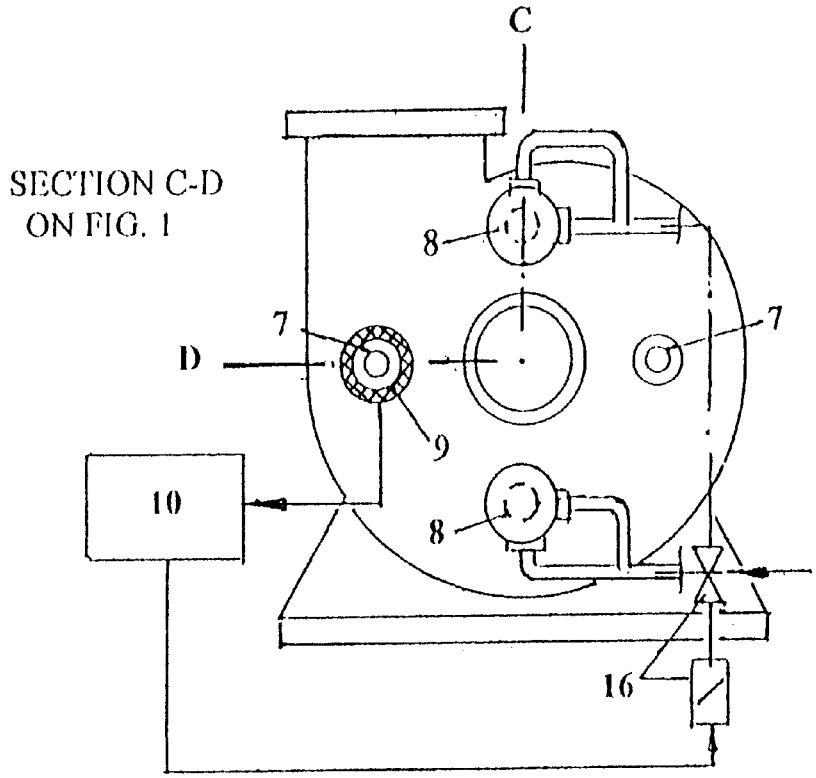
FIG. 2 is a schematic view of the pump from the inlet side.

Referring to FIGS. 1 and 2 it can be seen that the new pump consists of an impeller (1) surrounded with an outlet casing chamber (2). The casing chamber is internally faced with two controlling sideplates (3, 4) installed annularly inside the chamber along its walls and serve as the chamber supplementary walls. The sideplates are connected to driving cylinders (8) for moving them axially relative to the impeller. The sideplates' surfaces have a concave form with gradually increasing curvature which enables them to direct the liquid flow outlet from the impeller into a double inward spiral (17). This is an optimal form of the outlet chamber flow for reducing abrasive wear, causing the wear to be uniform inside the pump and for sustained high efficiency. When abrasive suspensions are pumped, the sideplates can be made of less wearable materials and can be made to cover the chamber surface and protect against wearing. A sealing cuff may be inserted in the clearing (5) between the chamber and the sideplates, when pumping suspensions. The sideplates are mounted on two pairs of shafts (6,7). One pair serves as driving shafts (6) being installed into driving cylinders (8) and are connected to the piston. The second pair of shafts are pilot shafts and extend out of the chamber. The pilot shafts assist in the correct axial movement of the sideplate. One of the pilot shafts (7) is inserted into an induction coil (9) used as a detecting element (sensor) connected to the microprocessor (10) of the control system to provide control for changing the pumping parameters automatically.

Figure 3:
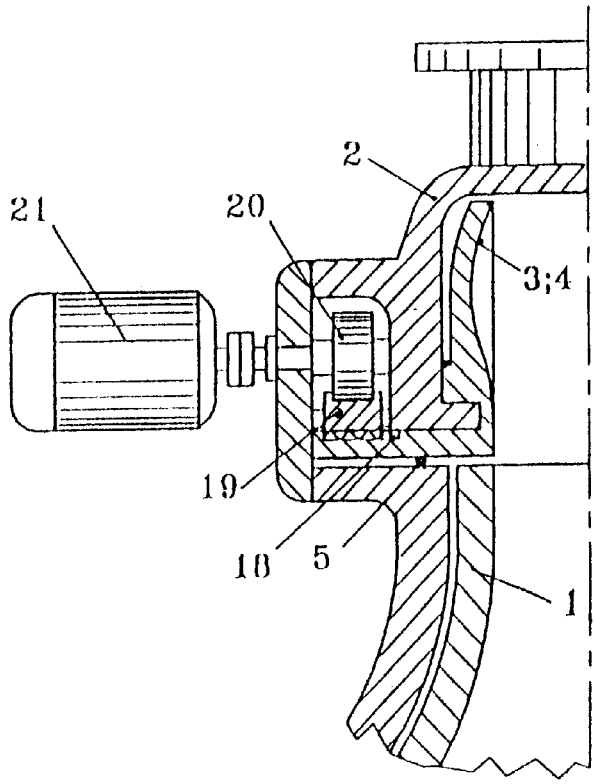
FIG. 3 is a schematic sectional view of the electric driving mechanism for moving the sideplates.

The sideplates can be moved axially by aerodrive, hydrodrive, or else by an electrodrive mechanism. In the case of an electrically driven mechanism, the said sideplate can be moved by a single motor using mechanical gearing for transferring the motor rotation motion to the necessary axial movement of the sideplate relative to the impeller. FIG. 3 shows such a design. The sideplate hub is supplied with a cylindrical thread (18) on which a spur gear wheel nut (19) is wound. The said nut is driven by a driving gear wheel (20) which is rotated by the electric motor (21).

In operation, when the electric motor rotates the driving gear (20), the nut (19) winds up on the sideplate hub thread which moves the sideplate relative to the impeller.

Particularly, by application of an electrodrive for moving the sideplates which are mounted on a pair of driving shafts, the said shafts can move together in a synchronized motion by using a toothed gear belt, gear chain or other type of gearing, being rotated by the electric motor.

Figure 4:
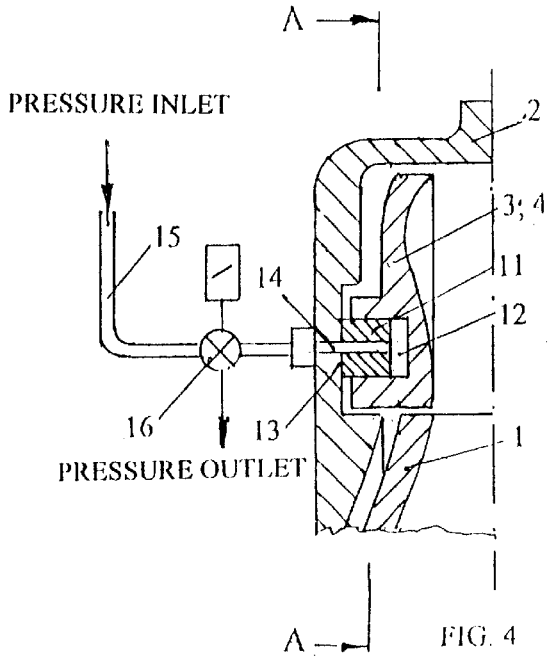
FIG. 4 is a schematic view of the internal hydrodriving mechanism.
Figure 5:
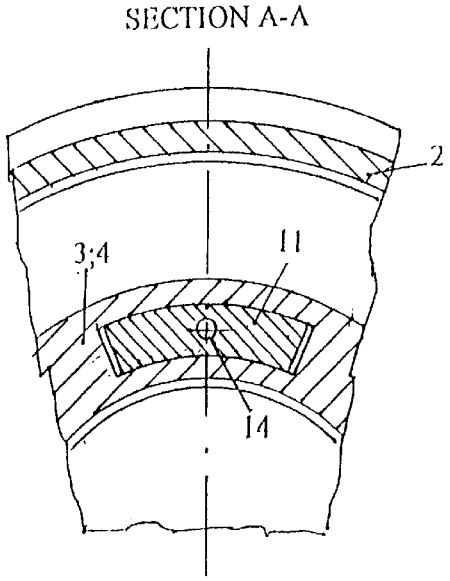
FIG. 5 is a fragmatic view of an annular piston part of the driving mechanism shown in FIG. 4.
Figure 6:
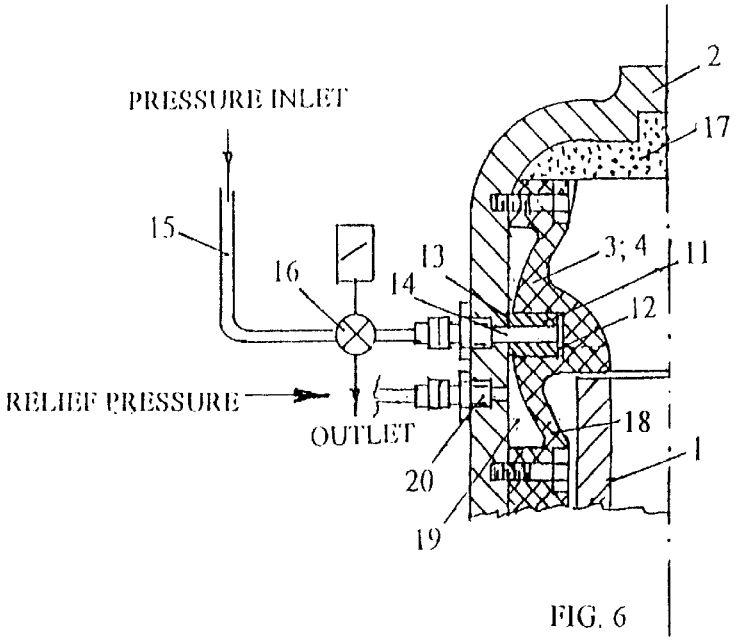
FIG. 6 is a schematic view of the internal hydrodriving mechanism accomplished by using elastic sideplates.

FIGS. 4, 5 and 6 present other embodiments of the hydrodriving mechanism design for moving the controlling sideplates (3, 4) with respect to the impeller. The hydrodriving mechanism in FIGS. 4, 5 is made as an annular piston (11) inserted inside the annular cylinder chamber (12) incorporated into the sideplate.

The piston can have the shape of a complete annulus or two or more parts thereof. FIG. 5 illustrates the case of a piston having parts of an annulus as its shape. These piston parts move with a tight fit in the corresponding annular cylinder chambers in the sideplate. The annular piston is fixed to the inner surface of the pump casing (13). A through passage (14) is made in the piston, connecting the annular cylinder chamber (12) with the feeding pipe (15). The feeding pipe, which is outside the casing, is supplied with a three way control valve (16).

The embodiment of the internal hydrodriving mechanism shown in FIG. 6, is accomplished using elastic (such as rubber) sideplates (3, 4) and is made as a part of the casing inner liner (17). As is known, rubber liners are usually used for the protection of the casing from abrasive wear. The movable sideplates are designed like an elastic rubber diaphragm. The rims of the sideplates are fastened to the inner surface of the casing. The sideplate has an annular cylinder chamber (12) and a movable diaphragmatic section (18). The section close to the rim has enough give such as to allow movement of the diaphragmatic sideplate to be displaced by the desired amount. An annular piston (11) is inserted into said annular cylinder (12) in the sideplate. The piston is fixed to the inner surface of the casing. In the piston a through passage (14) is made, which connects the annular cylinder chamber (12) to the pressure liquid pipe (15) which is outside the casing. This piston also directs the movement of the diaphragm section in the axial direction. A water tube (20) is connected to the pump discharge pipeline in order to relieve the pressure and maintain the hydrodynamic balance in the volume between the sideplate and the casing (19) as the sideplate is displaced.

In operation when the driving cylinder (8) starts functioning, the controlling sideplates (3,4) move in the axial direction relative to the impeller. This can be seen from the pump embodiment shown in FIG. 1. This movement of the sideplates relative to the impeller allows the outlet width($b_2$) of the impeller to change. The capacity(Q) of the centrifugal pump is proportional to the size $b_2$ of the impeller width. Therefore the replacement of the sideplates leads to the corresponding change of the pump discharge, i.e. its capacity.

When the controlling sideplate moves, the pilot shaft (7) connected with it moves as well. One pilot shaft is inserted into an induction coil (9) used as a detector. The pilot shaft, which is made from a conducting material, causes a signal to appear at a microprocessor (10) of the control system during its motion.

In the embodiments of the hydrodriving mechanism shown in FIGS. 4–6 when the valve (16) is open the fluid pressure is supplied to the annular cylinder chamber (12) resulting in the moving of the sideplate relative to the impeller. This movement decreases the outlet width $b_2$, accordingly the pump capacity is decreased. The reverse movement of the sideplate takes place when the valve (16) is directed such as to release the fluid pressure from the annular chamber. This movement of the sideplate takes place due to the fact that the force on the sideplate from the hydrostatic pressure is less on the side of the annular chamber than on the opposite side. The area of the sideplate from the annular chamber side is reduced by the area of the annular piston. Hence the force is less on this side.

The reverse movement of the sideplates can also be achieved by using various additional means. One such way is to connect the sideplate to a spring which forces the sideplate back when the hydrodrive fluid pressure is relieved from the annular chamber.

As was previously described, the pumping capacity is varied through changing the impeller outlet width by moving the controlling sideplates. Since the sideplates serve as supplementary chamber walls, during the said movement of the sideplates the geometrical size and volume of the casing outlet chamber also changes simultaneously. This is a principle factor in the design.

Thus, in this new design, since the impeller outlet width is partly changing and the pump discharge is being reduced, the volume of the casing is also reduced correspondingly. This prevents the creation of vortex flow in the casing chamber. In addition, the sideplates are designed such that the movement of the liquid flow in the casing outlet chamber is in the form of a double inward spiral which is optimal for reducing abrasive wear. Both the control of the chamber volume by the movement of the sideplates and the shape of the sideplates causing spiral motion of the liquid, prevent vortex formation and improves the efficiency of the pump while varying its parameters.

In addition, the sideplates design reduces the pump casing from abrasive wear and that permits it to be used for pumping suspensions containing abrasive or other solid components. It may be seen that the design of this pump is no more complicated than the standard pumps used for abrasive suspensions.

The proposed pump will enable any capacity and pressure combination. Thus the invention will by very useful for industrial technologies that require variability in the pumping of liquids, particularly suspensions in industries such as chemical, mining and construction.

What is claimed is:

1. A centrifugal pump providing variable capacity and pressure, comprising:

a casing having an outlet chamber;

an impeller rotatable in said casing;

a set of controlling sideplates installed in said outlet chamber movable parallel to the rotational axis of said impeller; positioned such as to change the outlet width and the outlet chamber volume, said sideplates having an inwardly facing concave form with gradually increasing curvature enabling said sideplates to direct a liquid flow along each of said sideplates into an inward spiral;

a driving mechanism connected to said sideplates, for axial movement of said sideplates;

said sideplates comprising a pair of pilot shafts extending from said outlet chamber into an induction coil for sensing and controlling movement of said sideplates;

said centrifugal pump further comprising a control system whose main function is adjusting the axial displacement of said sideplates which automatically controls the variable pumping parameters.

2. A centrifugal pump as claimed in claim 1, wherein said driving mechanism comprises a pair of pilot shafts connected to said sideplates, and connected to external hydrodriving cylinders for moving said sideplates.

3. A centrifugal pump as claimed in claim 1, wherein said driving mechanism comprises an electric motor and mechanical gearing which translates the rotary motion of said electric motor into a linear axial motion of said sideplates.

4. A centrifugal pump as claimed in claim 1, wherein said driving mechanism is internal to said casing and is hydrodriven, said internal hydrodriving mechanism comprising an annular piston fixed to said outlet chamber which is inserted into a corresponding annular cylinder in each of said sideplates, said annular piston having a through passage which connects said annular cylinder to a pipe supplying the hydraulic fluid, wherein the fluid pressure controls the movement of said sideplates.

5. A centrifugal pump as claimed in claim 4, wherein said internal hydrodriving mechanism comprises elastic sideplates, the rims of said elastic sideplates are connected to said casing, wherein said elastic sideplates have a diaphragmatic section, which allows movement of said elastic sideplates.

* * * * *